US012152480B2

(12) United States Patent
Johnson

(10) Patent No.: US 12,152,480 B2
(45) Date of Patent: Nov. 26, 2024

(54) REAL-TIME FRACTURE VOLUME MEASUREMENTS AND PREDICTIONS

(71) Applicant: Frac Science Group LLC, Sugar Land, TX (US)

(72) Inventor: Wesley W Johnson, Kemah, TX (US)

( * ) Notice: Subject to any disclaimer, the term of this patent is extended or adjusted under 35 U.S.C. 154(b) by 0 days.

(21) Appl. No.: 18/337,300

(22) Filed: Jun. 19, 2023

(65) Prior Publication Data

US 2024/0026766 A1 Jan. 25, 2024

Related U.S. Application Data

(60) Provisional application No. 63/366,646, filed on Jun. 19, 2022.

(51) Int. Cl.
*E21B 43/267* (2006.01)
*E21B 49/00* (2006.01)

(52) U.S. Cl.
CPC ..... *E21B 43/267* (2013.01); *E21B 49/008* (2013.01); *E21B 2200/20* (2020.05)

(58) Field of Classification Search
CPC ..... E21B 43/14; E21B 43/12; E21B 43/26; E21B 43/267; E21B 47/06; E21B 49/00; E21B 47/00
See application file for complete search history.

(56) References Cited

U.S. PATENT DOCUMENTS

| | | | | |
|---|---|---|---|---|
| 5,377,104 | A | 12/1994 | Sorrells et al. | |
| 9,581,004 | B2 | 2/2017 | Ciezobka et al. | |
| 11,313,211 | B2 | 4/2022 | Johnson | |
| 11,572,776 | B2 | 2/2023 | Johnson et al. | |
| 2012/0318500 | A1 | 12/2012 | Urbancic et al. | |
| 2016/0047232 | A1 * | 2/2016 | Palomarez | E21B 47/107 166/250.12 |
| 2016/0177706 | A1 | 6/2016 | Holland et al. | |

OTHER PUBLICATIONS

Translation and image of RU 2541983 (Year: 2015).*
Translation and image of CN 106884640 (Year: 2017).*
Ciezobka et al, Hydraulic Fracturing Test Site (HFTS)—Project Overview and Summary of Results, Prepared for Presentation at Unconventional Resources Technology Conference, Houston, Texas, Jul. 23-25, 2018.

(Continued)

*Primary Examiner* — Zakiya W Bates
(74) *Attorney, Agent, or Firm* — McAughan Deaver PLLC

(57) ABSTRACT

A system for assessing the characteristics of one or more geological formations that includes a programmable processing system configured receive at least one data stream including (1) a stream of well-pressure measurements, where each item of well-pressure measurement data corresponds to the pressure within the geological formation at a given time, (2) a stream of data associated with the flow of water and/or slurry into the geological formation at different times, and (3) a stream of data associated with the flow of sand into the geological formation at different times, where the programmable processing system is further configured to categorize fracturing events into different categories.

6 Claims, 4 Drawing Sheets

(56) References Cited

OTHER PUBLICATIONS

Cipolla et al., Diagnostic Techniques to Understand Hydraulic Fracturing: What? Why? and How?, Prepared for Presentation at 200 SPE/CERI Gas Technology Symposium, Calgary, Alberta, Canada Apr. 3-5, 2000.
Cleary et al., Enhancement of Real-time Hydraulic Fracturing Models With Full 3-D Simulation, Prepared for Presentation at the SPE Gas Technology Symposium, Dallas, Texas Jun. 13-14, 1988.
Crockett et al., A Complete Integrated Model for Design and Real-Time Analysis of Hydraulic Fracturing Operations, Prepared for Presentation at the 56th California Regional Meeting of the Society of Petroleum Engineers, Oakland, California, Apr. 2-4, 1986.
Madasu et al., Deep Recurrent Neural Network DRNN Model for Real-Time Multistage Pumping Data, Prepared for Presentation at the Arctic Technology Conference, Houston, Texas Nov. 5-7, 2018.
Paryani et al., Real-Time Completion Optimization of Fracture Treatment Using Commonly Available Surface and Fracing Data, Prepared for Presentation at SPE Canada Unconventional Resources Conference, Calgary, Alberta, Canada, Mar. 13-14, 2018.
Suarez-Rivera et al., Optimized Lateral Landing Depth for Improved Well Production, Prepared for Presentation at the Unconventional Resources Technology Conference, San Antonio, Texas Aug. 1-3, 2016.

* cited by examiner

400

500

600

REAL-TIME FRACTURE VOLUME MEASUREMENTS AND PREDICTIONS

CROSS REFERENCE TO RELATED APPLICATIONS

This application claims priority to U.S. provisional patent application No. 63/366,646 filed om Jun. 19, 2022, entitled Real-Time Fracture Volume and Predictions.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

The present disclosure relates to apparatus and methods for determining and predicting the volume of fractured formation being produced or to result from a fracturing operation.

In general, hydraulic fracturing involves the injection of water, sand, and/or chemicals into a well to break up and/or stimulate and/or expand underground rock to provide access to stored underground oil and/or gas reserves.

Because the costs for a fracturing (or fracing) operation can be high, it is desirable to understand whether the time, materials and energy associated with the fracturing operation are being invested productively and/or to assess or predict whether the performance of additional fracing activity will likely enhance the ultimate goal of well formation—production of oil and/or gas.

Conventional techniques have failed to provide optimum information concerning the efficiencies of a given fracing operation and/or the likely production resulting from such an operation. This, at least in part, is a result of the fact that many conventional processes attempt to determine the total number of rock fractures created during a fracing operation, and fail to differentiate between different types of created fractures and/or between fractures more likely to result in the ultimate production of oil and gas and fractures less likely to produce such results.

A goal of the present disclosure is to provide an apparatus and methods that can be beneficially used to more actually determine the total fracture volume created during a fracing operation, to predict the likely volume form continued fracing operations and/or predict the impact of a fracing operation on the ultimate production of oil and gas.

It is to be understood that the discussion above is provided for illustrative purposes of the appended or ultimately issued claims or those of any related patent application or patent. Thus, none of the appended claims, ultimately issued claims or claims of any related application or patent are to be limited by the above discussion or construed to address, include, or exclude each or any of the above-cited features or disadvantages merely because such were mentioned herein.

BRIEF SUMMARY OF THE INVENTION

A brief non-limiting summary of one of the many possible embodiments of the subject matter disclosed herein is a system for assessing the characteristics of one or more geological formations comprising a programmable processing system configured receive at least one data stream, the at least one data stream including at least: (1) a stream of well-pressure measurements, where each item of well-pressure measurement data corresponds to the pressure within the geological formation at a given time, (2) a stream of data associated with the flow of water and/or slurry into the geological formation at different times, and (3) a stream of data associated with the flow of sand into the geological formation at different times; wherein the programmable processing system is further configured, to processes the received at least one data stream to identify fracturing events and categorize at least some of such events into each of the following categories: fracturing events corresponding to the creation of relatively long, rapidly occurring fractures that occur when fluid is injected into formation at rates greater than the formation can absorb; fracturing events that correspond to complex, relatively rapidly occurring fractures that typically result from the breaking rock and the entry of water and/or slurry into the crated fracture, wherein such fracturing events are associated with a drop in formation pressure followed by a pressure recovery with time; fracturing events corresponding to fractures caused by high stress from small sand build up at or near fracture tips; and fracturing events that correspond generally to the expansion of pre-existing naturally occurring micro-fractures.

This brief summary is not intended to limit or otherwise affect the scope of what has been disclosed and enabled or the appended claims, and nothing stated in this Brief Summary of the Invention is intended as a definition of a claim term or phrase or as a disavowal or disclaimer of claim scope.

BRIEF DESCRIPTION OF THE SEVERAL VIEWS OF THE DRAWINGS

The following figures form part of the disclosure of inventions and are included to demonstrate further certain aspects of the inventions. The inventions may be better understood by reference to one or more of these figures in combination with the detailed description of certain embodiments presented herein.

Figure 1:
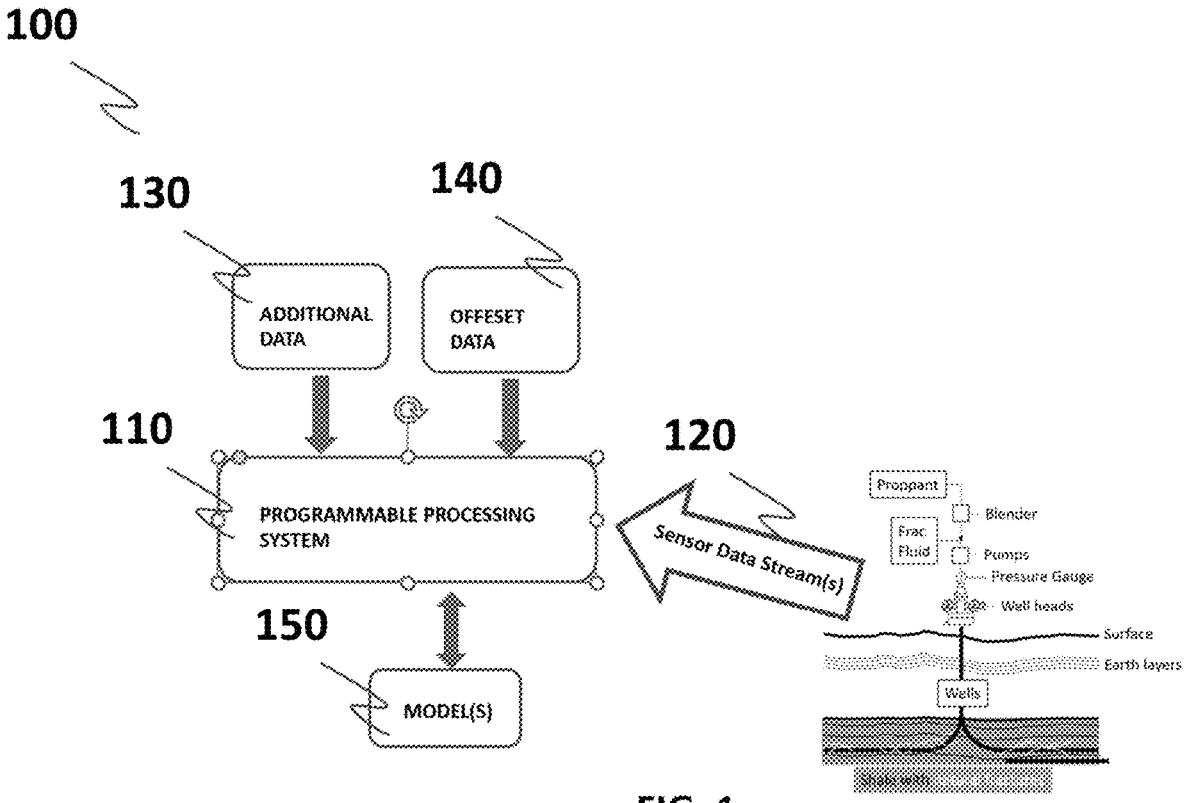
FIG. 1 illustrates a system that may be used to: (i) assess the characteristics of one or more underground geological formations; (ii) predict and measure fracture volumes associated with a hydraulic fracturing operation; (iii) promote optimum natural microfracture expansion while avoiding screen out; and/or (iv) predict production characteristics.

While the inventions disclosed herein are susceptible to various modifications and alternative forms, only a few specific embodiments have been shown by way of example in the drawings and are described in more detail below. The figures and detailed descriptions of these embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts illustrated and taught by the specific embodiments.

DETAILED DESCRIPTION

The Figures described above, and the written description of specific structures and functions below, are not presented to limit the scope of the inventions disclosed or the scope of the appended claims. Rather, the Figures and written description are provided to teach a person skilled in this art to make and use the inventions for which patent protection is sought.

A person of skill in this art having benefit of this disclosure will understand that the inventions are disclosed and taught herein by reference to specific embodiments, and that these specific embodiments are susceptible to numerous and various modifications and alternative forms without departing from the inventions we possess. For example, and not limitation, a person of skill in this art having benefit of this disclosure will understand that Figures and/or embodiments that use one or more common structures or elements, such as a structure or an element identified by a common reference number, are linked together for all purposes of supporting and enabling our inventions, and that such individual Figures or embodiments are not disparate disclosures. A person of skill in this art having benefit of this disclosure immediately will recognize and understand the various other embodiments of our inventions having one or more of the structures or elements illustrated and/or described in the various linked embodiments. In other words, not all possible embodiments of our inventions are described or illustrated in this application, and one or more of the claims to our inventions may not be directed to a specific, disclosed example. Nonetheless, a person of skill in this art having benefit of this disclosure will understand that the claims are fully supported by the entirety of this disclosure.

Those persons skilled in this art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure.

Further, the use of a singular term, such as, but not limited to, "a," is not intended as limiting of the number of items. Also, the use of relational terms, such as, but not limited to, "top," "bottom," "left" "right" "upper," "lower," "down," "up," "side," and the like are used in the written description for clarity in specific reference to the Figures and are not intended to limit the scope of the invention or the scope of what is claimed. Aspects of the inventions disclosed herein may be embodied as an apparatus, system, method, or computer program product. Accordingly, specific embodiments may take the form of an entirely hardware embodiment, an entirely software embodiment or an embodiment combining software and hardware aspects, such as a "circuit," "module" or "system." Furthermore, embodiments of the present inventions may take the form of a computer program product embodied in one or more computer readable storage media having computer readable program code.

Items, components, functions, or structures in this disclosure may be described or labeled as a "module" or "modules." For example, but not limitation, a module may be configured as a hardware circuit comprising custom VLSI circuits or gate arrays, off-the-shelf semiconductors such as logic chips, transistors, or other discrete components. A module also may be implemented as programmable hardware devices such as field programmable gate arrays, programmable array logic, programmable logic devices, or the like. Modules also may be configured as software for execution by various types of processors. A module of executable code may comprise one or more physical or logical blocks of computer instructions that may be organized as an object, procedure, or function. The executables of a module need not be physically located together but may comprise disparate instructions stored in different locations that when joined logically together, comprise the module and achieve the stated purpose or function. A module of executable code may be a single instruction, or many instructions, and may even be distributed over several different code segments, among different programs, and across several memory devices. Similarly, data may be identified and illustrated herein within modules, and may be embodied in any suitable form and organized within any suitable type of data structure. The data may be collected as a single dataset or may be distributed over different locations including over different storage devices, and may exist, at least partially, merely as electronic signals on a system or network. Where a module or portions of a module are implemented in software, the software portions may be stored on one or more computer readable storage media.

When implementing one or more of the inventions disclosed herein, any combination of one or more computer readable storage media may be used. A computer readable storage medium may be, for example, but not limitation, an electronic, magnetic, optical, electromagnetic, infrared, or semiconductor system, apparatus, or device, or any suitable combination of the foregoing. More specific, but non-limiting, examples of the computer readable storage medium may include the following: a portable computer diskette, a hard disk, a random access memory (RAM), a read-only memory (ROM), an erasable programmable read-only memory (EPROM or Flash memory), a portable compact disc read-only memory (CD-ROM), a digital versatile disc (DVD), a Blu-ray disc, an optical storage device, a magnetic tape, a Bernoulli drive, a magnetic disk, a magnetic storage device, a punch card, integrated circuits, other digital processing apparatus memory devices, or any suitable combination of the foregoing, but would not include propagating signals. In the context of this disclosure, a computer readable storage medium may be any tangible medium that can contain or store a program for use by or in connection with an instruction execution system, apparatus, or device.

Computer program code for carrying out operations of one or more of the present inventions may be written in any combination of one or more programming languages, including an object-oriented programming language such as Java, Python, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. The remote computer may be connected to the user's computer through any type of network, including a local area network (LAN) or a wide area network (WAN), or the connection may be made to an exterior computer for example, through the Internet using an Internet Service Provider.

FIG. 1 illustrates a system 100 that may be used to: (i) assess the characteristics of one or more underground geological formations; (ii) predict and measure fracture volumes associated with a hydraulic fracturing operation; (iii) promote optimum natural microfracture expansion while avoiding screen out; and/or (iv) predict production characteristics. Data can be offset in time within the same stage or offset in distance from offset wells of known location.

As illustrated the exemplary system includes a programmable processing system 110 that, in one embodiment, takes the form of a cloud-based computing system. In general, the programmable processing system 110 receives one or more data streams 120 associated with a hydraulic fracturing operation being performed on a given well, wells or formation. It should be appreciated that references herein to a well are intended to encompass references to the formation in which the well is formed and that references to a formation are intended to refer to a well in the formation. As such, all references here in to a well, a formation and/or a well/formation should be understood to also refer to a well, a formation, and/or the well and the formation in which the well is formed. In some cases, different completed intervals in a well penetrate different formations.

The data streams 120 provided to the programmable processing system may take the form of "real-time" data streams, in that each data stream corresponds to a stream of data items collected substantially in real-time. One example of such a data stream is a stream of well-pressure measurements, where each item of data corresponds to the well pressure at a given time. Other examples of data streams include a data stream associated with measurements of the water/slurry flow rate (e.g., in barrels-per-minute); a data stream associated with sand-flow (e.g., in pounds per gallon); and/or a data stream associated with sand size and/or temperature and/or any other well characteristic to be processed by the programmable processing system.

Additionally, or alternatively, each data stream 120 may take the form of a "historical" data stream in that each data stream may reflect a stream of data items recorded sometime in the past. The value of historical data may be used to predict future measurements, to know whether the rock is of better or worse quality.

It will be appreciated that the distinction between a real-time data feed and a historical data feed is somewhat arbitrary, in that there will likely be at least some time latency between the generation of each item in the data stream and the reception of that data item by the programmable processing system.

In general, the data associated with each data stream 120 will have some indication reflecting a time when the data item was detected. Such time indication can take the form of a specific timestamp associated with each data item and indicating when the data item was sampled, a relatively time indication, e.g., data indicating a start time, the time interval between measurements, and the measurement number (e.g., 15th sample) associated with each data item, or some other indication of time.

In addition to providing time data, each data stream 120 may provide additional information concerning each, all or some of the data items in the data stream. For example, in certain applications data may be provided concerning different well sites. In such application some or all of the data streams may be provided with an indication of the well associated with the data.

In one exemplary embodiment, the data is sent to the programmable processing apparatus over a single communication link and the programmable processing apparatus will process the received data to associate each data item with a particular well (if data from multiple wells is being provided) and to associate each data item with a particular point in time.

In one embodiment all of the data associated with a given well (e.g., pressure, water flow rate, sand rate, temperature, rock quality) will be time-aligned since well characteristics associated with each data category will all be sampled at the same time for a given well. Alternative embodiments are envisioned where the relevant characteristics are sampled at different points in time and then the data is interpolated, or otherwise processed, to generate adjusted data sets that are generally time aligned and potentially predictive of future measurements.

In embodiments where the well pressure is provided as an input to the programmable processing system, the pressure reading may be provided by a quartz gauge having a low signal-to-noise ratios. In such embodiments, it can be beneficial to have the gauge provide the detected pressure measurements in their "raw" form (e.g., without any smoothing, averaging, or other pre-processing) such that all or substantially all processing of the raw pressure signal measurements is done by the programmable processing system, In one embodiment, the data streams 120 are provided in a time-aligned manner (or are processed through interpolation or otherwise) such that the data within each data stream—or each adjusted data stream—reflects the data item at a point that is of known seconds after the corresponding preceding data item. For example, a data stream reflecting well-pressure valves, sample at one second intervals, would have this characteristic. Note that other sampling periods can be used (e.g., data sampled ever ½ second, every $10^{th}$ of a second, every 1.5 seconds).

In the example of FIG. 1 the programmable processing system 110 receives a first pressure data stream from a first well undergoing hydraulic fracturing and a second data stream from a second offset well located some distance from the first well. In this example, each data stream is associated with pressure data separated by one second intervals. Ideally, both data streams will be associated with time-aligned pressure data sampled on a one-second interval. The provision of data from one or more offset wells is optional.

In addition to receiving one or more data streams the programmable processing system can also receive other user inputs in the form of additional data items 130 that can provide information related to the well associated with the well or the geological formation to be analyzed. Such information can include, for example, known information concerning the well or formation at issue, such as specific location, general type, depth, length, and other physical characteristics such as organic content, or natural fracturing intensity associated with the well or formation. Such information can also, additionally, or alternatively, include information believed to be accurate or relevant by the user.

In the exemplary embodiment of FIG. 1, the data streams 120 received the programmed processing system are: (i) well head pressure measurements taken on a 1 second interval from a well undergoing hydraulic fracturing; (ii) water flow rate measurements taken on a 1 second interval in time alignment with the pressure measurement for the well undergoing hydraulic fracturing; and (iii) sand concentration measurements taken on a 1 second interval in time alignment with the pressure measurement for the well undergoing hydraulic fracturing. In the example the programmable processing system will also be provided with an indication reflecting the size of the sand being used at any given time and an indication of the well associated with the data stream. The flow of the data streams from the well undergoing hydraulic fracturing is reflected by line in FIG. 1.

As reflected in FIG. 1, the programmable processing system 110 can, in addition to receiving the data streams also receive one or more offset data streams 140 (or set of offset data streams). In one example, a single offset data stream 140 (designated) will be a stream of data corresponding to pressure measurements of a different location in the same well, or a well that is offset from the well undergoing the hydraulic fracturing operation.

THE MODEL(S): In addition to including apparatus for receiving the data sensor and data inputs described above, the exemplary programmable processing system discussed herein includes one or more models 150 of the well/formation associated with the well/formation to be analyzed by the system. Such models can take many forms and can take the form of a single model (e.g., one that receives a single set of inputs and provides a single set of outputs); a grouping of multiple models (e.g., where several different models each receive the same (or substantially the same inputs) and each produces a separate set of outputs); and/or a combination of multiple models (e.g., where each of several models receives some or all of the inputs provided to other models, each model produces one or more outputs and the outputs are processed by the programmable processing system to produce a set of outputs). In embodiments where a combination of multiple models is used, the outputs can reflect all or any of: a selection of the output from one of the model; a combination (e.g., average, weighted average, neural networks, etc.) of the outputs from some or all of the models, or any other combining process (e.g., discard high/low model output and average the remainder).

As described above, inputs to the programmable processing system 110 can include additional data 130 associated with the well/formation under analysis. Such additional data can be used to tune one or more of the system models to more closely align with the well/formation under analysis. For example, the programmable processing system can be initialized using a base mode (or models) that is associated with a certain type of well or formation natural fracture system generally, and that base model can then be tuned by the processing system to mode closely align with the well/formation under analysis by, for example, using data obtained from wells/formations in the same geographical area and/or having similar geological characteristics.

GENERAL OPERATION: In general operation, the exemplary system of FIG. 1 will receive the provided sensor data and other inputs, and apply them to the model (or models) to generate data and analysis that can be used in real-time to optimize a fracturing operation and/or used to assess the likely productive capability of a well/formation, and for other purposes.

Exemplary processes that can be provided by the programmable processing system 110 of this disclosure are processes to provide data concerning the characteristics of the fractures created during a fracturing operation (or frac job) and/or provide forecasted data concerning the anticipated fracture patterns, types, and volumes that will result from continued fracturing activity.

In connection with the above-described analysis, the programmable processing system can monitor the well-pressure and other data provided to the system to detect fracturing events as they occur and to provide information about the various detected fracturing events.

For example, in one embodiment, the programmable processing system 110 can use the received sensor data and other input to detect fracturing events based on the changes in the well pressure readings. In such an example a change in the pressure readings over a given period of time of a specific magnitude, can be used to indicate a fracturing event. For example, a rapid change in the pressure reading form an increasing pressure to a decreasing pressure can indicate a fracturing event.

In addition to being able to detect fracturing events, the programmable processing system described herein can be used to identify and provide information about the type and nature of the fracturing event. For example, in one embodiment, the programmable processing system can be used to categorize the fracturing events into at least one of the following event types:

1. TYPE I fracturing events, which correspond generally to large, long, rapidly occurring fractures associated of the type sometimes referred to as "planar" fractures. These fractures generally occur when fracturing fluid is injected into a well/formation at rates greater than the well/formation can absorb.
2. TYPE II fracturing events, which correspond generally to smaller, more complex, relatively rapidly occurring fractures that typically result from the hydraulic fluid breaking rock and the entry of frac fluid into the fracture. These fractures are typically associated with certain characteristic patterns of a drop in well/formation pressure followed by a pressure recovery with time.
3. TYPE III fracturing events, which correspond to sand fractures caused reduced leak-off and high stress from small sand build up at or near fracture tips.
4. TYPE IV fracturing events that correspond generally to the expansion of pre-existing naturally occurring micro-fractures (hereinafter "NMF's" or simply "Natural Fractures") within the well formation subject to the fracturing process. These events typically result in the expansion of NMFs that were present within the source rock within the well/formation.

The present inventors have determined that identification and assessment of the number of Type IV fracturing events associated with a given fracturing operation is of great significance because the detected number of Type IV fractures provides information both as to the quality of the source rock in the well/formation under analysis and the likely production available from the well/formation under analysis.

This is believed to be the case because it has been discovered that merely determining the total number of fractures produced during a fracturing operation (or even the total produced fractured area or volume) is not necessarily reflective of the quality of the source rock that has been fractured or the likely productive future of the fractured well or formation. Economic production requires both fracture volume and the presence of pores with high pressure oil and gas. Rather, the present inventors have determined that the assessment of the number of Type IV fracturing events is a better assessment of the true efficiency of the fracturing operation and the quality of the source rock natural fractures and pore pressure are more predictive of production of hydrocarbons. This is because NMFs are believed to be the result of expansion caused by the formation of hydrocarbons from organic material. As such, a detection/assessment of the extent of NMFs in a source rock, provides a good indication of the likely productivity of the source rock with respect to the production of hydrocarbons.

Further, being able to differentiate between a fracturing operation that produces a large number of Type IV fracturing events (as opposed to a fracturing operation that merely produces a high, non-differentiated fracturing count) is significant because a fracturing operation that produces a high fracture count, but where the fracture events are mostly Type I or Type II, for example, could be reflective a large number of fracturing events, but a low likelihood of meaningful hydrocarbon production.

Figure 2:
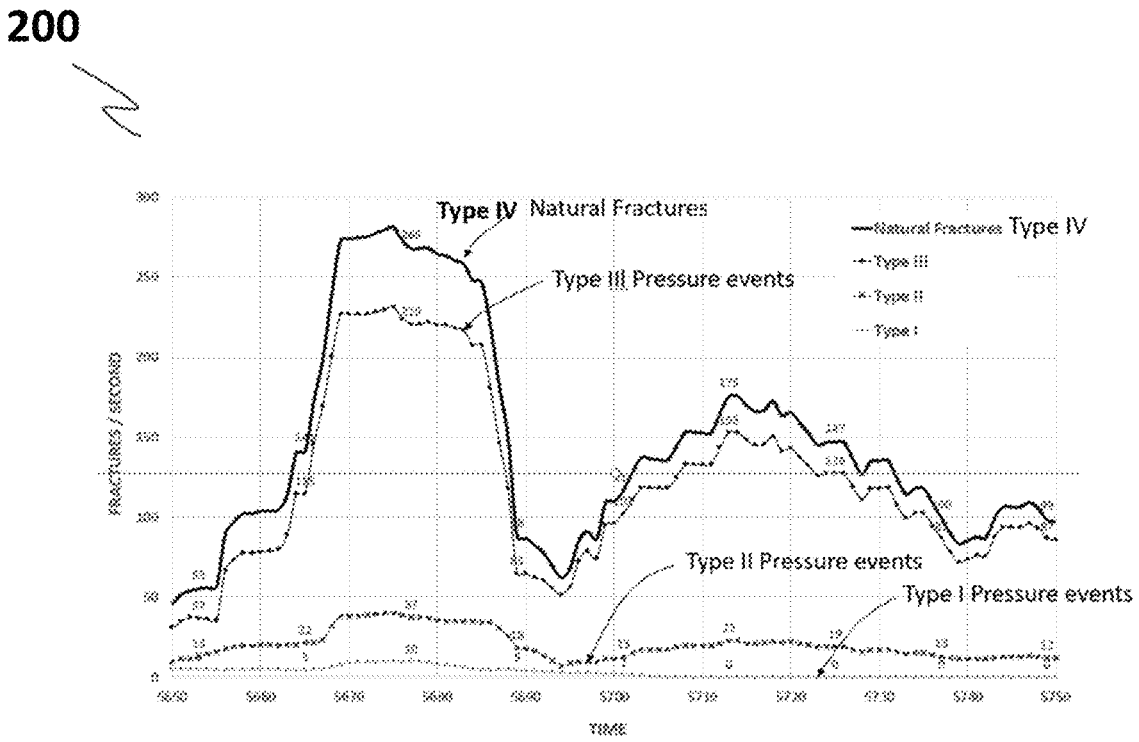
FIG. 2 illustrates an exemplary output for one exemplary programming processing system constructed in accordance with the present system which shows, at each point in time the volume of fracturing (or pressure) events for each of the four types of events discussed herein.

FIG. 2 an exemplary output 200 for one exemplary programming processing system constructed in accordance with the present system, as shown it illustrates, at each point in time, the volume of fracturing (or pressure) events for each of the four types described.

Figure 3:
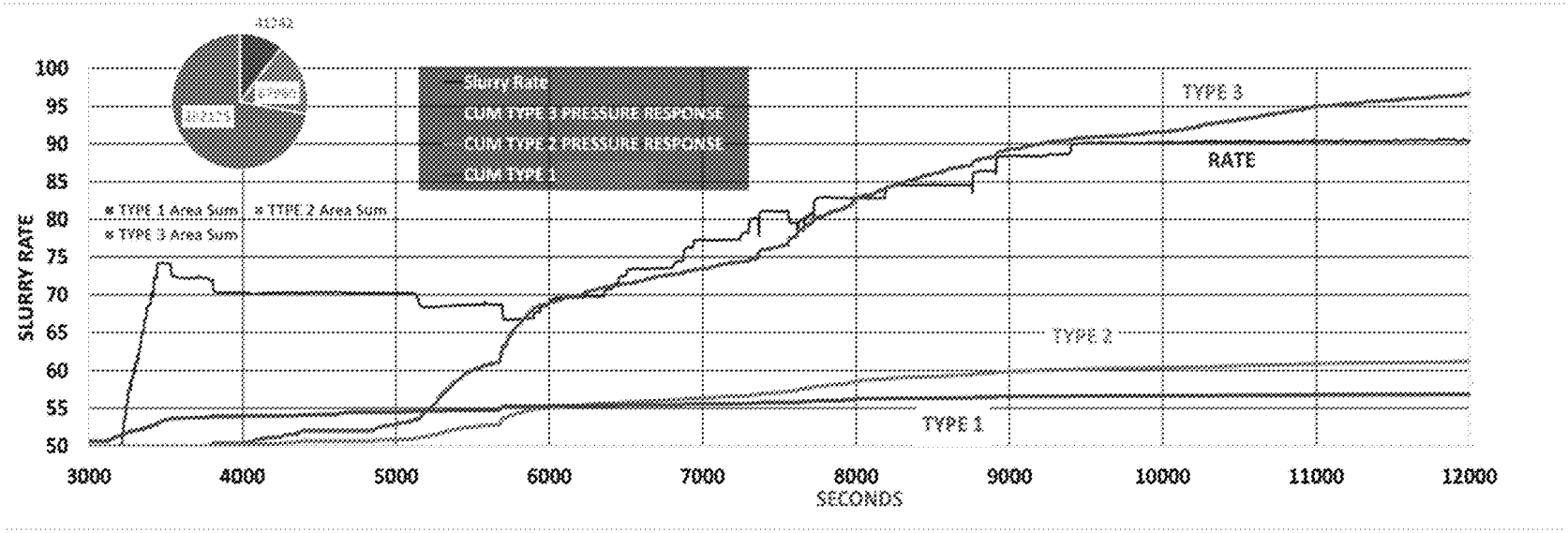
FIG. 3 provides an indication of the cumulative Type I (Type 1); Type II (Type 2); and Type III (Type 3) fracturing (or pressure events) over time along with the real-time measurements for the slurry rate (e.g., the rate at which the combined mix of sand and fracturing fluid are being pumped into the well/formation).

In addition to providing real-time information as reflected in FIG. 2, the programmable processing system of the present disclosure can also provide cumulative information and/or a combination of real-time and cumulative information. For example, FIG. 3 provides an indication 300 of the cumulative Type I (Type 1)(red); Type II (Type 2)(blue); and Type III (Type 3)(green) fracturing (or pressure events) over time along with the real-time measurements for the slurry rate (e.g., the rate at which the combined mix of sand and fracturing fluid are being pumped into the well/formation).

Figure 4:
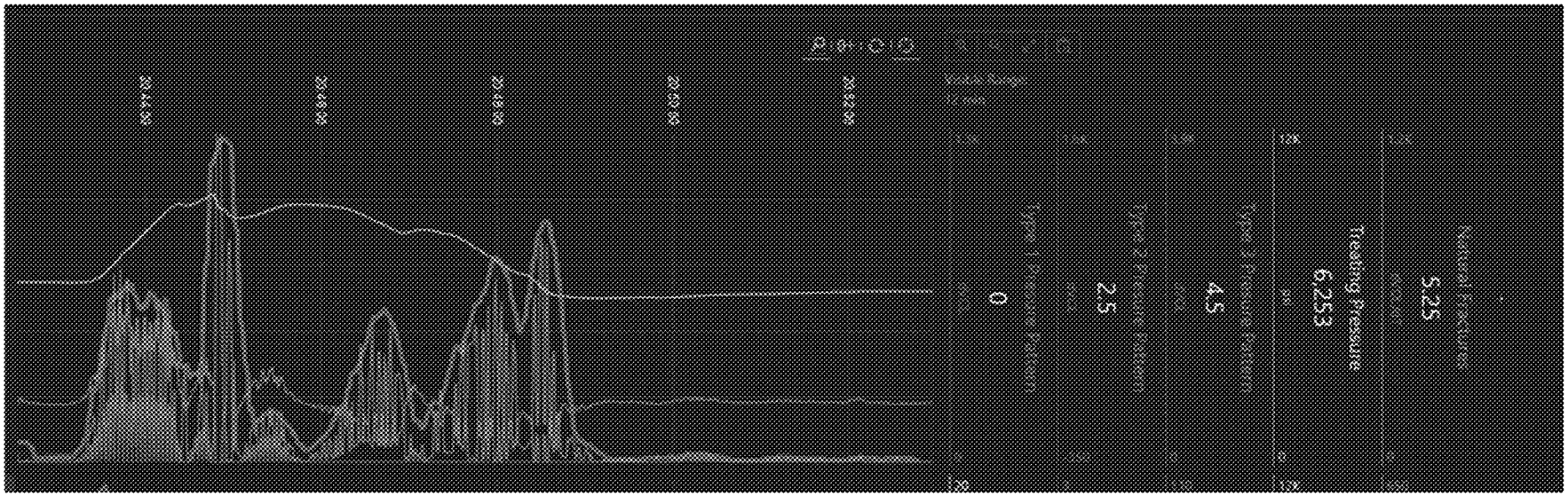
FIG. 4 provides an exemplary output from the programmable processing system that provides an indication of the Type 1, 2, and 3 fracture (pressure) events in terms of volume, and an indication of the natural fractures (or NMFs, brown curve) in terms of the change in volume per unit time FIG. 5 provides another exemplary output of one embodiment of a system constructed in accordance with the teachings of the present disclosure.

In addition to determining the type of pressure events, an exemplary programmable processing system of the present disclosure can determine the volumes associated with each type of fracturing events. FIG. 4 provides an exemplary output from the programmable processing system that provides an indication of the Type 1, 2, and 3 fracture (pressure) events in terms of volume, and an indication of the natural fractures (or NMFs, brown curve) in terms of the change in volume per unit time. As shown in FIG. 4 the pressure within the week, the slurry rate, and the proppant concentration can also be shown. Further, while not shown in FIG. 4, data reflecting the cumulative volume of the various types of fracture events can be provided as well.

As may be noted in FIG. 4, an exemplary programmable processing system constructed in accordance with the teachings of this disclosure can also provide indication of the fracture tip pressure. The present inventors have discovered that the fracture tip pressure does not necessarily equate with the detected pressure in at the well head. This is because the pressure at the well head is not equivalent to the bottom hole pressure within the well. As such, in certain embodiments of the present disclosure, the pressure information used to determine the number and types of the fracture (pressure) events is not the pressure data provided by the wellhead pressure sensors, but rather the determined bottom hole, or fracture tip pressure within the reservoir. In such embodiments, the bottom hole pressure in the well is determined using the pressure values provided by the well head pressure sensor and other pertinent data, such as the length, volume, and other physical characteristics of the well, temperature, type of fracturing fluid, and/or other relevant data, to compute the actual bottom hole pressure at each relevant time.

Figure 5:
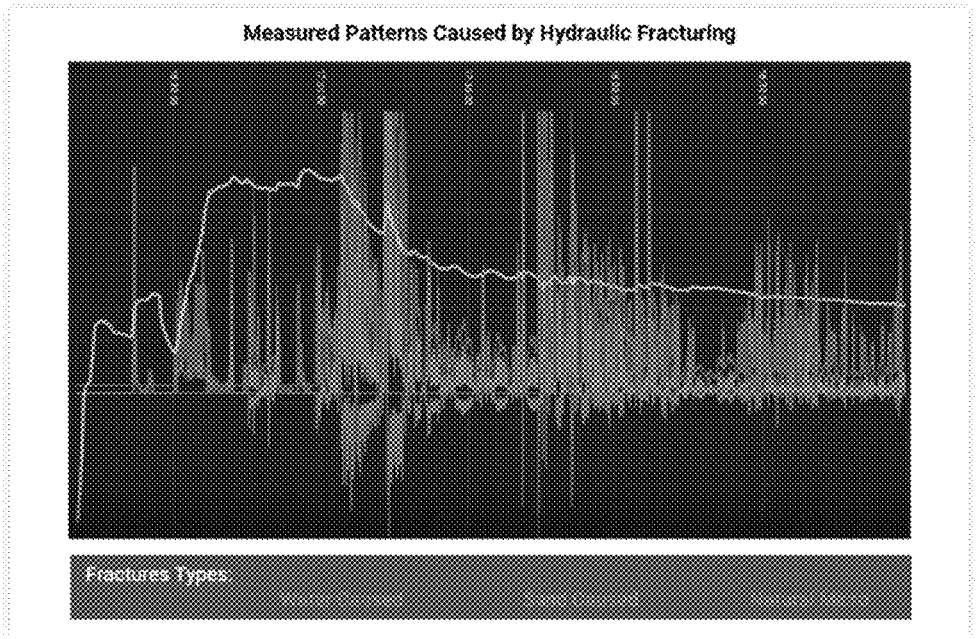

FIG. 5 provides another exemplary output of one embodiment of a system constructed in accordance with the teachings of the present disclosure. In FIG. 5, the various fractures identified by the various fracture cases are shown as follows: Fracture causes: Type 1 (red curve) too high rate; Type 2 (blue) water caused; Type 3 (green) sand-stress; and Type 4 (brown) Natural Micro Fractures In addition to the methods described above, the programmable processing system and the system described above can also be used to provide information concerning the projected hydrocarbon production characteristics and/or the total hydrocarbon volume of the formation. This is accomplished by having the programmable processing system measure the fall-off pressures for each stage of the well at various times. The fall-off pressures can be received by the system at any time that positive pressure is not being provided to the well. This can be, for example, at the conclusion of each frac-stage, during times where the frac pump is disabled for any reason (e.g., because of pump error) or during specified times during a frac process, or where pumping is complete.

Upon the receipt of the fall-of pressure data, the programmable processing system can process the data to provide information concerning the size and flow characteristics for each stage of the well/formation as each stage is fractured (and/or cumulatively for the well/formation as a whole) to provide information reflecting the total formation volume. Such information can include—among other things—estimated reservoir drainage by well/formation, stage, and zone.

In one embodiment, the information generated by the programmable processing system through processing fall-off pressure data can be used to generate and provide information that may be useful in assessing the optimal spacing and/or placing of stages and wells. For example, in one instance processing the information provided above may indicate that a particular portion of the well/formation has conditions such that the performance of a fracturing operation within that portion of the well/formation produces a higher number of desirable fractures (e.g., Type III fractures) than other portions of the well. Such information can be useful in that it can indicate that, for any offset wells or related wells in the same area, the fracture stage spacing within that portion of the formation may be less than for other sections of the well. Alternatively, or additionally, such information may be used to suggest the well path for any future wells to be drilled in the same area. As an example of spacing design, several treatment intervals (stages) can be fractured and studied for interference or fracture efficiency. If optimal stage intervals are measured, they can be indicative of well spacing. Spacing tests are much less expensive that well spacing tests because they can be measured with a portion of a single well. Offset wells of various spacings do not have to be sacrificed to measure optimal spacing.

In addition to providing information concerning the extent and type of fracturing events, a system constructed in accordance with the teachings of the present disclosure can be used to provide predictive information concerning the number and type of fracturing events that will occur during the course of a hydraulic fracturing operation. This predictive information can be provided through the use of the model discussed in connection with FIG. 1 above.

As noted above, the model (which may include multiple individual models) corresponds, to some extent, to the formation and/or source rock associated with the fracturing operation being analyzed. This model can be used to assess the received data and provide a forecasted prediction of the volume and type of fracture vents that will occur over a future interval, e.g., the next several or next 4-5 minutes. This forecasted data can then be used to adjust the fracturing process to optimize the overall fracturing operation.

For example, during one fracturing operation of a given well stage the forecasted data may show that the projected fracturing events are primarily Type 1 or Type 2 fracturing events, with few Type IV events. Under such situations, a user can decide to conserve valuable sand and/or hydraulic fluid by reducing the sand/fluid inputs for the operation and/or terminating the operation. Alternatively, if the forecasted information shows a large number of predicted Type IV fracture events (or Type III fracture events which could connect to Type IV fracture events), the user could decide to extend the fracturing operation and/or increase the fluid flow rate and/or the sand concentration.

In addition to the above the present system can be used to both avoid screen outs and/or avoid unnecessary avoidance of fracturing events.

As will be appreciated by those of ordinary skill, screen outs generally occur when the amount of sand being pumped into a well during a fracturing operation exceeds the capacity of the source rock to absorb the sand. Conventionally, potential screen outs are detected by observing a sharp increase in the wellhead pressure and are conventionally avoided by cutting back on the amount of sand slurry provided to the well. Such conventional approaches are not ideal because, in many instances, they do not identify the potential screen out in time for the screen out to be avoided or, they incorrectly identify the potential for a screen out and result in the unnecessary reduction in the amount of sand provided to the well, which could then result in an unnecessary reduction in the amount of desired fracturing events.

Because the present system can be used to predict the number and types of future fracturing events, it can be used to both more accurately avoid screen outs and to avoid unnecessary reduction in the provision of sand (and an unnecessary reduction in the desired fracturing events). This is because a detection of forecasted Type I and II fracturing events (which do not result in sand absorption by the source rock) in the absence of sufficient Type III and/or Type IV events (which do result in sand absorption) can suggest the potential of a screen out. As such, an embodiment of the present system can suggest a reduction in the provided sand volume and avoid the screen out based—not merely on a pressure reading—but rather on a detected indication of an inability of the source rock to absorb the provided sand.

Additionally, if an embodiment of the present disclosure detects a rapid increase in the well-head pressure (which would conventionally suggest cutting the provided sand) but also forecasts a sufficient volume of Type III (and/or Type IV) events to absorb the sane, then the system could recommend that no cutting of the sand occur, which could result in the occurrence of beneficial fracturing events that would not have occurred in a conventional approach was follows.

Sill further, through the forecasting of the volume and type of predicted fracturing events, a system constructed in accordance with the teachings of the present disclosure can be used to provide suggestions for the fracturing operation being analyzed. Thus, for example, if an embodiment of the present system is detecting and forecasting a high number of Type IV (and/or Type III) fracture events, the system may recommend an increase in the sand concentration and/or the rate at which hydraulic fluid (or slurry) is provided to the well. It is worth noting that pressure signals from reservoir fractures travel to the surface at ~4000 ft/sec in water. It takes about 2-4 seconds for pressure signals to reach surface. Sand introduced at the surface takes 2-4 minutes, or more to reach the tips of reservoir fractures.

Figure 6:
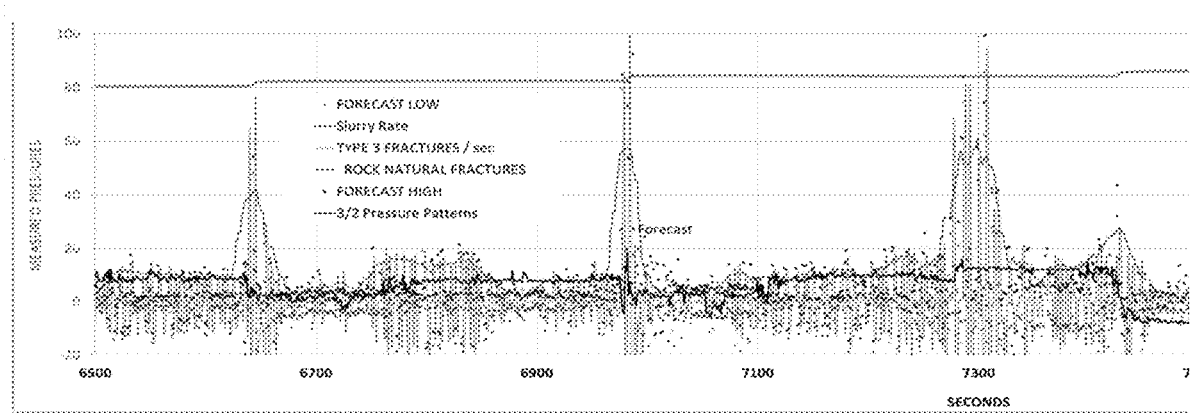
FIG. 6 provides an indication of the type of information that can be provided to a system user.

FIG. 6 provides an indication of the type of information that can be provided to a system user. In the example the system provides information concerning the forecasted number of desired fractures and indicates whether the forecast is high or low. Such information could then be used by an operator to determine whether they should adjust or maintain the current fracture operation conditions.

It will be noted that FIG. 6 also reflects the provision of information reflecting the number of Type 3 fracture events over the number of Type 2 fracture events. This data can be used to provide an assessment of the quality of the source rock as it has been determined by the present inventors that this information provides a good assessment of the potential productive quality of the rock.

What is claimed:

1. A system for assessing the characteristics of one or more geological formations comprising:

a programmable processing system configured receive at least one data stream, the at least one data stream including at least: (1) a stream of well-pressure measurements, where each item of well-pressure measurement data corresponds to the pressure within the geological formation at a given time, (2) a stream of data associated with the flow of water and/or slurry into the geological formation at different times, and (3) a stream of data associated with the flow of sand into the geological formation at different times;

wherein the programmable processing system is further configured, to processes the received at least one data stream to identify fracturing events and categorize at least some of such events into each of the following categories:

fracturing events corresponding to the creation of fractures that occur when fluid is injected into formation at rates greater than the formation can absorb;

fracturing events that correspond to complex fractures that typically result from the breaking rock and the entry of water and/or slurry into the created fracture, wherein such fracturing events are associated with a drop in formation pressure followed by a pressure recovery with time;

fracturing events corresponding to fractures caused by stress from sand build up at or near fracture tips; and fracturing events that correspond generally to the expansion of pre-existing naturally occurring micro-fractures.

2. The system of claim 1 wherein the programmable processes is further configured to receive at least one historical data stream reflecting a stream of recorded data items, where the historical data items were recorded at a time that pre-dates the earlier time of a data item within the at least one data stream.

3. The system of claim 1 wherein the programmable processing system is configured to receive data associated with the flow of water and/or slurry into the geological formation in terms of barrels-per-minute.

4. The system of claim 1 wherein the programmable processing system is configured to receive data associated with the flow of sand in the geological formation in terms of pounds per gallon.

5. The system of claim 1 wherein the programable processing system is configured to receive data within the at least one data stream in the form of a data comprising data indicating a start time, the time interval between measurements, and a measurement number associated with each data item.

6. The system of claim 1 wherein the programable processing system is further configured to receive data within the at least one data stream in the form of a data comprising a timestamp associated with each data item and indicating when the data item was sampled.

* * * * *